US009038426B2

(12) United States Patent
Flynn

(10) Patent No.: US 9,038,426 B2
(45) Date of Patent: May 26, 2015

(54) LOCKING RESTRAINT DEVICE

(71) Applicant: Richard Flynn, Huntington, WV (US)

(72) Inventor: Richard Flynn, Huntington, WV (US)

( * ) Notice: Subject to any disclaimer, the term of this patent is extended or adjusted under 35 U.S.C. 154(b) by 0 days.

(21) Appl. No.: 14/025,759

(22) Filed: Sep. 12, 2013

(65) Prior Publication Data

US 2015/0068256 A1 Mar. 12, 2015

(51) Int. Cl.
*E05B 75/00* (2006.01)

(52) U.S. Cl.
CPC ..... *E05B 75/00* (2013.01)

(58) Field of Classification Search
CPC ..... E05B 75/00
USPC ..... 70/14–19
See application file for complete search history.

(56) References Cited

U.S. PATENT DOCUMENTS

| | | | | | |
|---|---|---|---|---|---|
| 636,439 | A * | 11/1899 | Maltby | 70/17 |
| 691,941 | A * | 1/1902 | Headson | 70/17 |
| 885,811 | A * | 4/1908 | Ward | 70/17 |
| 982,933 | A * | 1/1911 | Busch | 70/17 |
| 1,147,423 | A * | 7/1915 | Murphy | 70/17 |
| 1,719,698 | A * | 7/1929 | Gross | 70/17 |
| 2,344,348 | A * | 3/1944 | Forsell | 70/17 |
| 4,441,746 | A | 4/1984 | Corby | |
| 7,922,739 | B2 | 4/2011 | Downey | |
| 8,397,545 | B1 * | 3/2013 | Lash | 70/16 |
| 2010/0206017 | A1 * | 8/2010 | Garibaldi | 70/16 |

* cited by examiner

*Primary Examiner* — Christopher Boswell
(74) *Attorney, Agent, or Firm* — Michael L. Greenberg, Esq.; Greenberg & Lieberman, LLC

(57) ABSTRACT

A manacle configured to detain or arrest a person by placing pressure on a spring-loaded handle which closes a clamp. The clamp dynamically adjusts to the wrist size of a target individual or subject. When the clamp is open, the first end and the second end are systematically disposed on either side. When the clamp is closed around the wrist of an individual, they provide a maximum gripping force capable of detaining the individual from movement. Furthermore, the ratchet portion of the tool allows for the device to close around a wrist in an adjustable fashion, meaning the tool will automatically adjust to the circumference of an individual's wrist upon deployment.

8 Claims, 5 Drawing Sheets

LOCKING RESTRAINT DEVICE

CONTINUITY DATA

This is a non-provisional application of provisional patent application no. 61/699,920 filed on Sep. 12, 2012, and priority is claimed thereto.

FIELD OF THE PRESENT INVENTION

The present invention relates to security devices, and specifically to those devices used to restrain the limbs of an individual with ease. It is the intent of the present invention to provide an individual with a means of rapidly restraining a second individual (subject) by means of limiting his or her movement, preferably from the wrists. The present invention relates to a new way to apprehend, detain, and/or arrest a person.

BACKGROUND OF THE PRESENT INVENTION

In the realm of security, equipment and technology are often a law enforcement officer's first and best line of defense both for themselves, and for enforcing the laws of society. An assortment of devices have been fashioned to aide the law enforcement officer in his duties, including security items such as a baton, fire arm, and conventional handcuffs. Each of these items has proven to be effective in deterring the resistance from encounters with criminals. Unfortunately, all of these items are not necessarily easy to deploy in a tense moments where a struggle is exhibited. Ideally, the arresting officer desires to restrain the individual as quickly as possible, in order to prevent harm to himself or others, which often results from a chase or brawl. Handcuffs—often said to be the ultimate restraint device, are conventionally only applicable after the subject has surrendered efforts to flee or fight. If there were a way to apply a wrist restraint device without the need of the subject's surrender, time, energy, and injury could be saved.

In the history of Jiu Jitsu, the early master's primary move for submission was the wrist lock. The wrist lock is regarded as the ultimate offensive or defensive weapon within the realm of Jiu Jitsu and other martial arts practices. It is the foundation or primus of Jiu Jitsu that if an individual controls a subject's wrist, he or she therefore controls the subject's elbow, and if the individual controls the subject's elbow, he or she controls their shoulder as well. If the individual is able to control the subject's shoulder, he or she may control their entire body. There are as many as 10 variations of the wrist lock, as it is a particularly powerful technique for restraining an individual, and the technique is useful to disable a person's primary weapon—their hands. In Jiu Jitsu, a person's defense is conventionally to attack the other person's thumb that is applying a wrist lock. The attack of the thumb is one of the only ways an assailant has at escaping a conventional wrist lock. If there were an effective means by which to apply a wrist lock without leaving the thumb susceptible for attack, wrist locks would be even more effective.

Thus, there is a need for a device capable of restraining a subject's wrists on-the-fly while in the throes of a chase or struggle. Ideally, such a device would protect the user's thumb, in order to assure that the wrist lock remains effective and is not easily repelled.

U.S. Pat. No. 4,441,746, granted to Corby et al., and filed on Jan. 4, 1982 cites a "Tool for Retrieving Out-of-Reach Objects." While Corby et al. features a jaw-like apparatus, unlike the present invention, the jaws are not lockable, and are intended for the retrieval of objects rather than the detainment or restriction of a subject.

U.S. Pat. No. 7,922,739, filed by Downey and issued on Apr. 12, 2011 lists a "Surgical Instrument with Trigger Control." Unlike the present invention, Downey proposes the use of a single finger of a user to 'control an attached, elongated tubular portion extending from the ergonomic handle,' whereas the present invention is fashioned to be employed by a user's grip, and is not designed for surgical purposes.

SUMMARY OF THE PRESENT INVENTION

The present invention is a manacle device having a simplified construction capable of exacting an effective wristlock on a subject on-the-fly. The present invention provides assurance, ease, and reliability of use, while maintaining a reasonably low manufacturing cost. The present invention consists of a first arm and a second arm, comprising a pair of jaws configured to enclose the wrist of a subject. The jaws of the present invention are configured to be snapped shut around the wrist of a subject via a spring-loaded locking mechanism. Some parts present invention are capable of pivoting in order to obtain a secure fit around the wrist of a subject. In accordance with the specification of invention, the jaws, amounting to a cuff, are controlled by applying pressure to the hand grip, which then applies leverage systematically disposed on opposite sides of the main body. The symmetrical arrangement of the first arm and the second arm of the present invention ensures that the force provided by a spring is applied to a detainee's wrist directly and rapidly. It is envisioned that the present invention may be used for either offensive use and/or defensive action.

The engineering design of the present invention provides a maximum gripping force after the application of a relatively minimal effort by the user. The force of the grip provided by the present invention is preferably suited to the size of the individual. The present invention is engineered and designed so that it may preferably be fabricated using either 60 or 61 aluminum, which is poured into molds, minimizing the expense of construction and ensuring that heavy machining is not necessary. These and other advantages of the invention will hereinafter become more apparent from the following description and drawings illustrating the preferred embodiment thereof.

DETAILED DESCRIPTION OF THE PREFERRED EMBODIMENT

Figure 1:
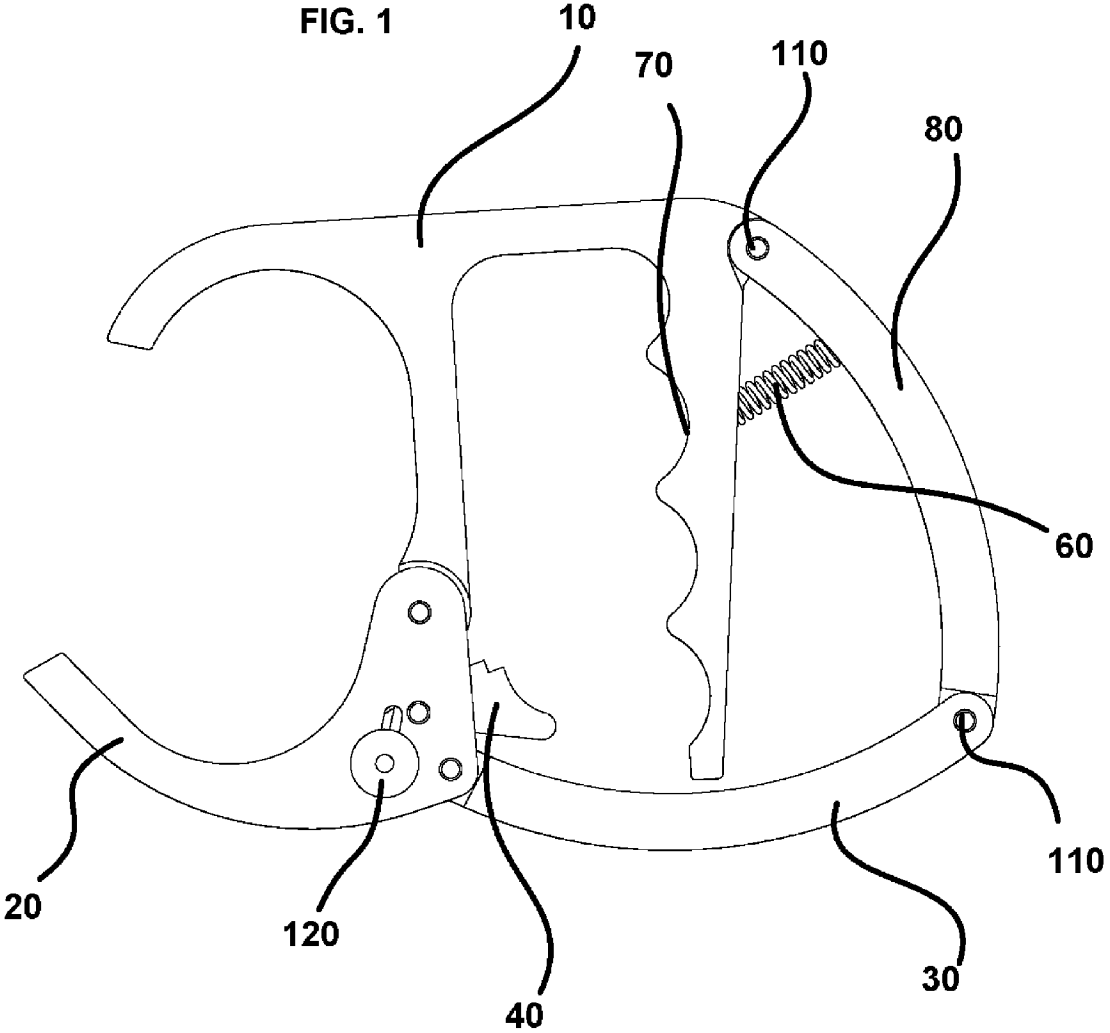
FIG. 1 exhibits the preferred embodiment of the present invention as viewed from the front.

The present invention is a mechanical manacle, capable of delivering a wrist lock to the wrist of a subject via force exerted via a main body spring (60), which is triggered by the hand of a user. The present invention is preferably ergonomically constructed, such that the present invention is comfortable and easy to use for the user. The hand grip (70) of the present invention preferably maintains a set of cutouts designed to fit around a user's fingers, as seen in FIG. 1.

Figure 2:
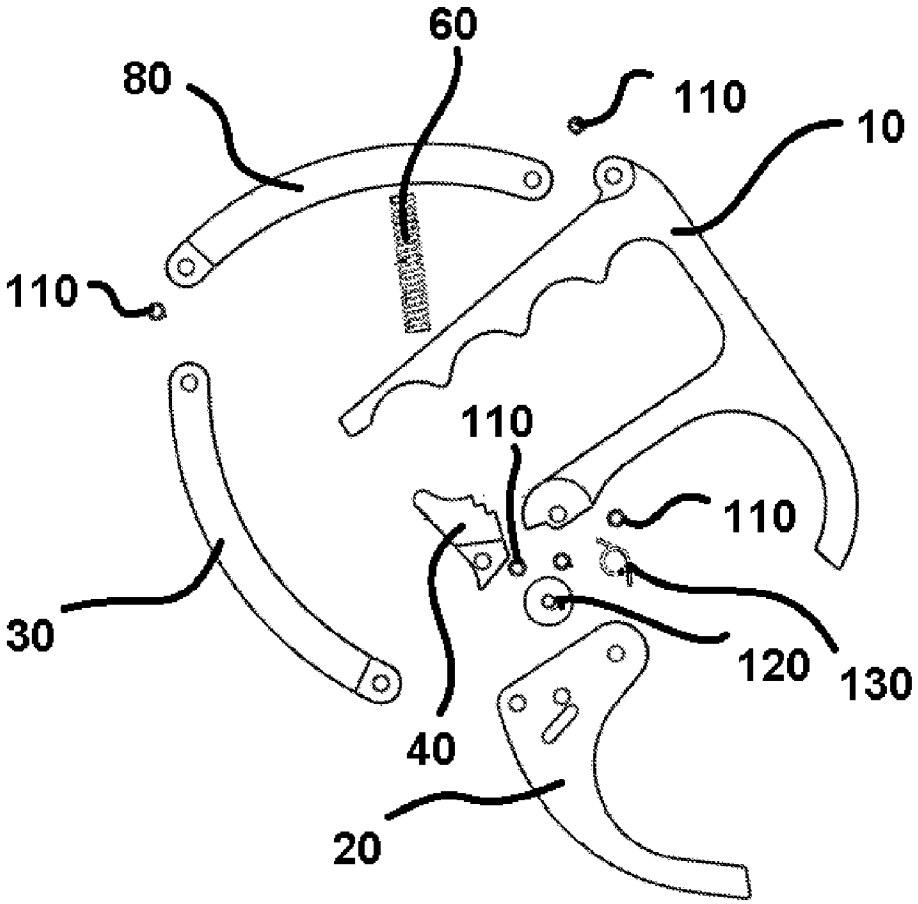
FIG. 2 is an exploded view of the present invention from the front.
Figure 3:
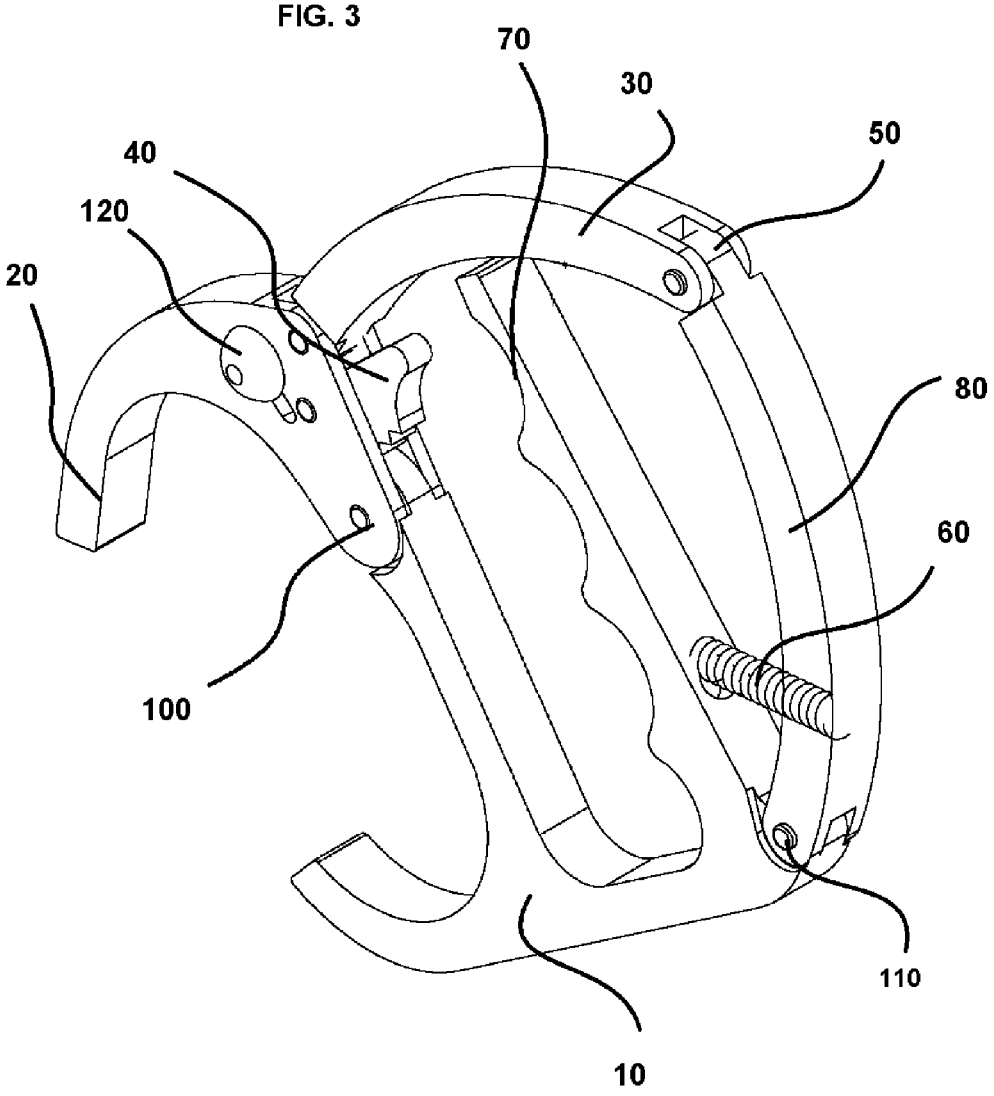
FIG. 3 depicts a perspective view of the preferred embodiment of the present invention from the rear.
Figure 4:
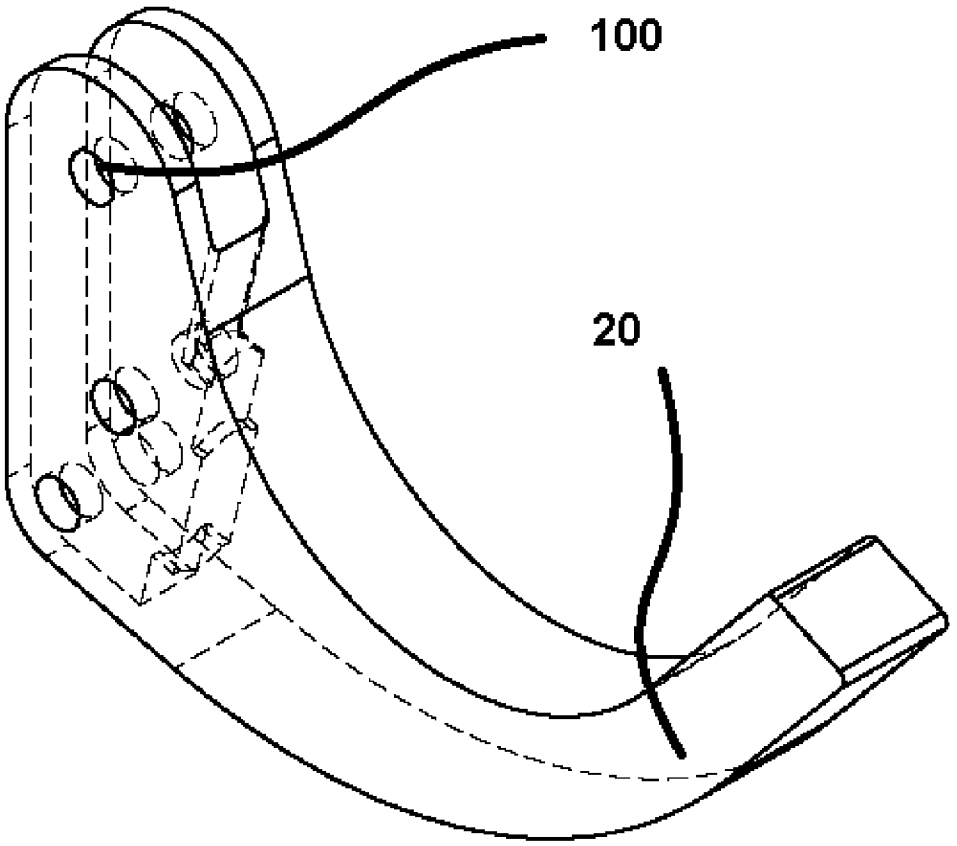
FIG. 4 shows an alternate form of the secondary body of the present invention, shown without the lock pin, as seen in an environmental view from the side.
Figure 5:
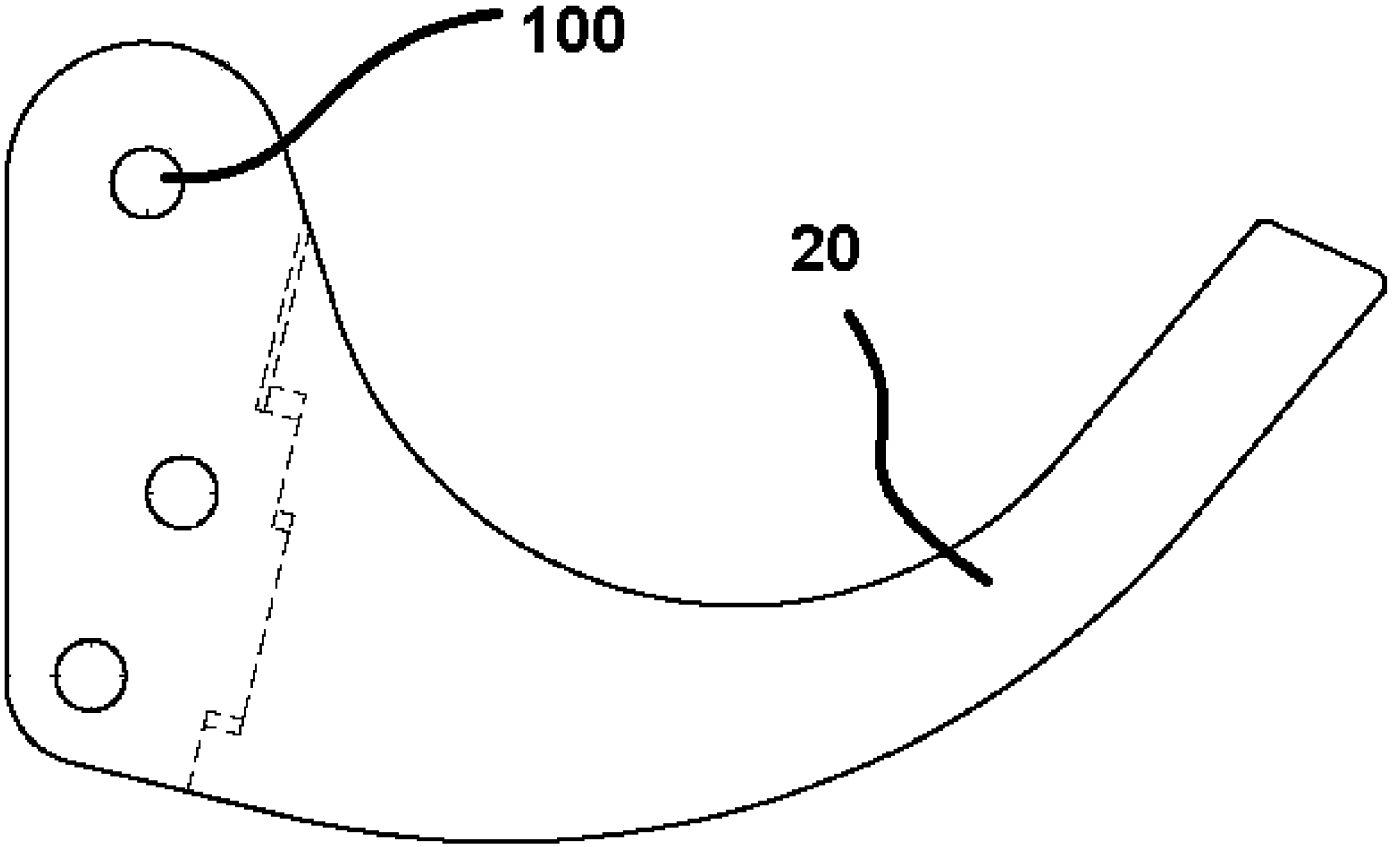
FIG. 5 displays an alternate embodiment of the secondary body of the present invention without the lock pin as seen from the front.

The general assembly process for the present invention can be outlined as follows: first, the four primary body parts are to be cast in a sturdy, preferably metallic material, such as aluminum or steel. The primary body parts to be cast include the first arm (80), the second arm (30), the cuff primary body (10) and the secondary body (20). Both the first arm (80) and the second arm (30) are configured with a male end and a female end, as seen in FIG. 2. After casting the primary body parts, the male end of the cuff primary body (10) is inserted into the female end of the first arm (80) and is secured in place via a cuff pin (110). The cuff pin (110) may remain in position due to friction, may be riveted in place, or may be screwed into position. However, it is envisioned that any other conventional means of flexibly securing the first arm (80) to the second arm (30) may be employed. Similarly, cuff pins (110), rivets or screws are also placed in mounting hole (100) in order to secure the primary body (10) to the secondary body (20), as seen in FIG. 2 and FIG. 4.

Next, the primary body spring (60) is attached to the cuff primary body (10) and the secondary body (20). It is preferably held in place by a cutout sized to the circumference of the primary body spring (60) found on the cuff primary body (10) and the secondary body (20). The cuff primary body (10) and the secondary body (20) of the present invention are held together via cuff pins (110). The male end of the first arm (80) may then be secured to the female end of the second arm (30) via a cuff pin (110). This junction of the male end of the first arm (80) and the female end of the second arm (30) is fashioned to function as a flexible joint (50), allowing a regimented bidirectional range of movement. Similar joints exist at the juncture between the primary body (10) and the first arm (80), as well as between the second arm (30) and the secondary body (20). Upon deployment of the present invention, each joint is employed to flexibly alter the shape of the present invention, such that it is capable of retaining the wrist of a subject between the primary body (10) and the secondary body (20), which form a cuff, similar to a pair of jaws, at the front of the manacle.

Subsequently, a trigger lock spring (130) is to be placed into position found in the secondary body (20), as seen in FIG. 2. A trigger lock (40), shown in FIG. 2, is a switch that functions in conjunction with the trigger lock spring (130), and is preferably placed into position such that the trigger lock (40) is in communication with the trigger lock spring (130). The trigger lock spring (130) is designed to ensure that the trigger lock (40) returns back into an initial 'home' position after deploying the present invention onto the wrist of a subject. The trigger lock spring (130) and the trigger lock (40) are preferably placed in communication with the secondary body (20) of the present invention. The trigger lock (40), when pressed by the user, is designed to function as a release switch for the present invention. The trigger lock (40) provides the mechanism by which the present invention may be released from the wrist of a subject after the manacle has been sprung by the user. The trigger lock (40) is preferably placed in a position that is inaccessible to the subject, yet within reach of the use. Additionally, the trigger lock (40) is preferably held in place by a cuff pin (110). However, it is envisioned that any other conventional means may be employed to secure the trigger lock (40) in position.

A lock slide pin (120) is preferably placed within the secondary body (20) such to indicate that the present invention is either locked shut (in the position designed to function as a wrist lock against a subject), or open, and ready to be deployed. The first arm and the second arm are preferably equipped with a male end and a female end designed to make construction of the present invention simple. Subsequently, the male end of the second arm (30) is preferably inserted into the female end of the secondary body (20), and is secured in place with a cuff pin (110). Finally, the secondary body (20) is to be attached to the primary body (10) and secured in place via another instance of a cuff pin (110). At this point, the present invention is fully assembled, and is ready for use.

The present invention is preferably applied to the wrist of a subject when the user squeezes the hand grip (70). This action pushes the second arm (30) forward, causing the secondary body (20) to rotate toward the primary body (10), forming an enclosed or semi-enclosed oval, sized appropriately to the wrist of the subject. When pressure is applied to the hand grip (70), the secondary body (20) is leveraged against the primary body (10) in order to enclose on the wrist of a subject for restraint or detention. The trigger lock (40) preferably provides for three primary positions, which allow for a variation in the tightness of the present invention on the wrist of a subject, similar to the ratcheting locking mechanism found on conventional handcuffs. This ratcheting mechanism is preferably enacted via a series of teeth placed on the trigger lock (40), which can be seen in the depiction of the trigger lock (40) in FIG. 2. The lock slide pin (120) provides for easy and quick release of the present invention.

The present invention may be easily opened after deployment. In order to open the manacle, the user of the present invention preferably slides the lock slide pin (120) upwards, towards the secondary body (20), to the open position, followed by pressing the trigger lock (40), which releases the ratcheting lock held in place by the trigger lock spring (130), enabling the device to opened by the user's opposite hand.

Alternate embodiments of the present invention may include, but are not limited to, employing an alternative junction device to secure the first arm (80) and the second arm (30) to the primary body (10) and the secondary body (20) rather than the conventional male-to-female joint system employed in the preferred embodiment of the present invention. For example, a ball joint, or other similar conventional joint may be functionally employed to achieve the same end. Likewise, it can be envisioned that the first arm (80) and the second arm (30) could be one singular, bent member, designed to flex slightly when pressure is applied to the hand grip (70), and activate the device.

Similarly, alternate embodiments of the present invention may have electronic components, such as an incorporated light or an electronic automatic release system incorporated into the design of the present invention. Alternately, it can be envisioned that the shape of the present invention could be altered slightly, in order to better conform to a standard utility belt. Likewise, alternate embodiment of the present invention could be weaponized further, for instance adding a low voltage Taser-like apparatus to the primary body (10) of the present invention, in order to expedite the restriction of movement of the subject.

Other alternate embodiments of the present invention could include variations to the primary body (10) and the secondary body (20) in order to size them to appropriately target other appendages of a subject, such as the ankles, or even the neck. In order to accomplish this, the primary body (10) and the secondary body (20) would be elongated to form a larger cuff, designed to encompass or partially encompass larger limbs, such as the ankles of a subject, or even the neck. Similarly, this embodiment would preferably include multiple sizing positions, held in place by a form of teeth found on the trigger lock (40), similar to those found in conventional handcuff cuff locking mechanisms.

Additionally, other embodiments of the present invention are crafted without the sliding lock pin (120), providing for a marginally lighter primary body (10) and slightly smaller secondary body (20) than embodiments which include a lock pin (120). Embodiments without a lock pin (120) preferably employ an alternate conventional form of trigger release to unlock the device by the user easily.

It is to be understood that the present invention is not solely limited to the invention as described in the embodiments above, but further comprises any and all embodiments within the score of this application.

I claim:

1. A portable restraint device comprising:

a cuff primary body, a secondary body;

wherein said cuff primary body is in communication with said secondary body via at least one cuff pin;

a primary body spring, said primary body spring configured to be compressed to store potential energy within said cuff primary body;

a hand grip, said hand grip unitary with said cuff primary body;

a first arm;

a second arm;

wherein said first arm and said second arm are configured to form an enclosed shape when in a closed position as a manacle;

wherein said first arm is in communication with said second arm and is secured with said at least one cuff pin;

a trigger;

a trigger lock;

a trigger lock spring, said trigger lock spring is housed within said secondary body providing tension to said trigger lock;

wherein said trigger is activated via compression of said hand grip against said first arm;

wherein said potential energy is conveyed to said secondary body upon activation of said trigger and said potential energy is converted to kinetic energy, closing the manacle upon trigger activation; and wherein said trigger releases said trigger lock spring.

2. The portable restraint device of claim 1, wherein compression of said hand grip forces said first arm to push forward towards said secondary body, leveraging said secondary body against said cuff primary body, aiding the closure of said manacle.

3. The portable restraint device of claim 1, wherein said trigger lock is equipped with teeth that provide for multiple opening degrees of said manacle.

4. The portable restraint device of claim 1, further comprising a lock pin, configured to slide along a junction of said cuff primary body and said secondary body in order to release said trigger lock.

5. The portable restraint device of claim 1, wherein said cuff primary body, said secondary body, said first arm, said second arm, and said handle grip are metallic.

6. The portable restraint device of claim 1, wherein said handle grip is equipped with indentations for comfortable finger placement.

7. The portable restraint device of claim 1, wherein said handle grip is equipped with padding.

8. The portable restraint device of claim 3, wherein said manacle automatically adjusts to the circumference of an individual's wrist upon deployment via activation of said trigger.

* * * * *